US008844934B2

(12) United States Patent
Dean et al.

(10) Patent No.: US 8,844,934 B2
(45) Date of Patent: Sep. 30, 2014

(54) HANGING TARGET FRAME

(76) Inventors: Jacob T. Dean, Enon, OH (US); Donald L. Wells, Donnelsville, OH (US)

( * ) Notice: Subject to any disclaimer, the term of this patent is extended or adjusted under 35 U.S.C. 154(b) by 138 days.

(21) Appl. No.: 13/537,691

(22) Filed: Jun. 29, 2012

(65) Prior Publication Data

US 2013/0001880 A1 Jan. 3, 2013

Related U.S. Application Data

(60) Provisional application No. 61/503,353, filed on Jun. 30, 2011.

(51) Int. Cl.
*F41J 1/10* (2006.01)
*F41J 5/24* (2006.01)
*F41J 9/16* (2006.01)

(52) U.S. Cl.
CPC ..... *F41J 1/10* (2013.01)
USPC ..... 273/407; 273/392; 273/380

(58) Field of Classification Search
USPC ..... 273/390–392, 406, 407; 248/339–341, 248/215; 211/113, 115, 119
See application file for complete search history.

(56) References Cited

U.S. PATENT DOCUMENTS 2,761,233 A * 9/1956 Brown ..... 47/41.1
2,899,204 A * 8/1959 Ratay ..... 273/392
5,263,721 A * 11/1993 Lowrance ..... 273/390
5,501,889 A * 3/1996 Church ..... 428/66.5
6,311,851 B1 * 11/2001 Knudsen et al. ..... 211/13.1
D494,050 S * 8/2004 Klein et al. ..... D8/373
7,234,671 B2 * 6/2007 Avinger ..... 248/215
7,338,048 B1 3/2008 Hulstine
7,644,927 B2 * 1/2010 Law ..... 273/407
7,669,819 B2 * 3/2010 Meyers ..... 248/215
7,681,887 B2 3/2010 Hensley
7,789,080 B2 * 9/2010 Fielding, Jr. ..... 124/27
7,845,646 B1 12/2010 Weber
7,887,017 B2 * 2/2011 Moran ..... 248/339
8,534,627 B2 * 9/2013 Kressin ..... 248/307
2005/0189458 A1 * 9/2005 Avinger ..... 248/301
2006/0220318 A1 * 10/2006 Law ..... 273/407
2007/0013138 A1 * 1/2007 Hinnant ..... 273/407
2010/0207000 A1 * 8/2010 Krausz ..... 248/222.14
2010/0225063 A1 9/2010 Wyrick et al.
2011/0024985 A1 2/2011 Potterfield et al.
2012/0068412 A1 * 3/2012 Diercks ..... 273/407

* cited by examiner

*Primary Examiner* — Mark Graham
(74) *Attorney, Agent, or Firm* — Fay Sharpe LLP; James E. Scarbrough

(57) ABSTRACT

A target for hanging on a frame has a hanging member having a first elongated arm, a second arm extending from the first arm and a third arm extending from the second arm. The first and third arms are parallel to each other and the second arm is perpendicular to said first and third arms. The third arm is shorter than the first arm. The hanging member has a thickness. A target disk has an elongated slot wherein the hanging member is inserted into the slot. The third arm extends through the slot and the second arm is received within the slot.

12 Claims, 3 Drawing Sheets

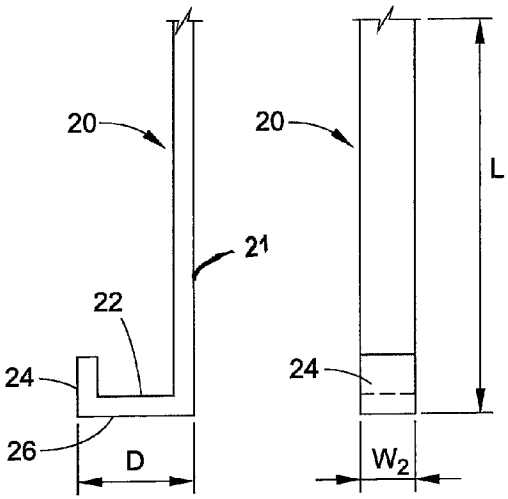
FIG. 3A
FIG. 3B
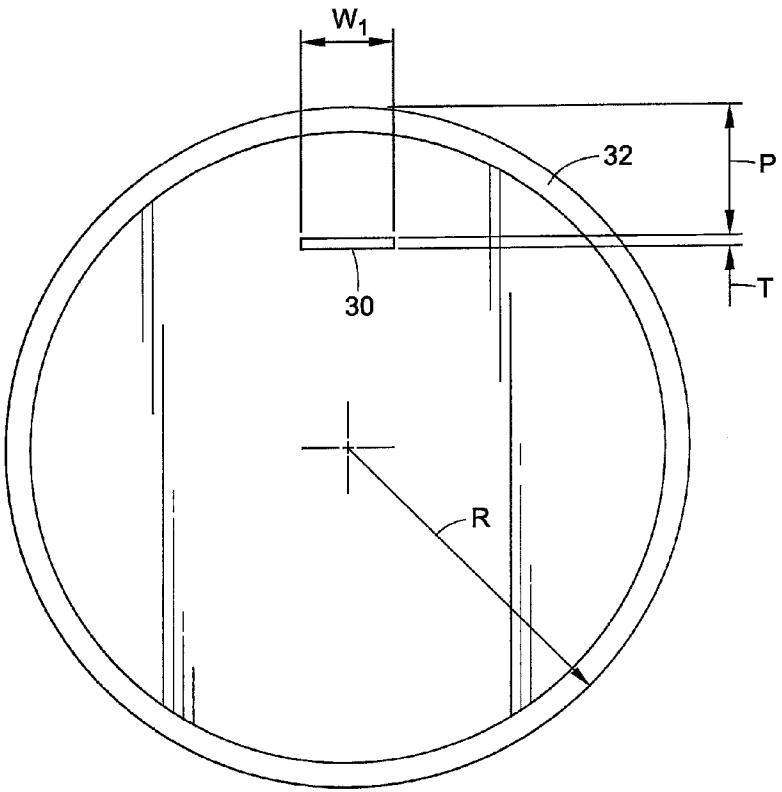
FIG. 2

HANGING TARGET FRAME

CLAIM OF PRIORITY

This application claims priority from provisional Ser. No. 61/503,353 filed on Jun. 30, 2011, which is hereby incorporated by reference in its entirety.

BACKGROUND OF THE DISCLOSURE

This disclosure relates generally to indoor or outdoor shooting sports. More particularly, it relates to an apparatus for shooting hanging targets. It also relates to an apparatus for measurement and calibrations of gun sights.

Clay targets such as clay pigeons and other targets have been used for many years for target shooting practice by gun enthusiasts and owners. However, some of the targets are stationary and are not removable or reusable. Also, some existing targets are not adapted to be hung from a frame or holder.

Thus, there is a need for a transportable target which can be hung on a variety of frames. The target itself can be removable from a frame or a wire affixed to the frame if necessary. The target may also be reusable if needed.

SUMMARY OF THE DISCLOSURE

This disclosure relates generally to indoor or outdoor shooting sports. More particularly, it relates to an apparatus for shooting hanging targets. It also relates to an apparatus for measurement and calibrations of gun sights.

The disclosure is an apparatus that can be secured to the ground or a holding device or frame with hanging wires and targets having slots for affixing the targets to the wires. The apparatus is transportable and can be made of a variety of materials. The targets can be made of clay or other suitable materials, and can be made of a variety of shapes and sizes with slots to be affixed to hanging wires.

In accordance with one aspect of the disclosure, a target for hanging on a frame has a hanging member having a first elongated arm, a second arm extending from the first arm and a third arm extending from the second arm. The first and third arms are parallel to each other and the second arm is perpendicular to the first and third arms. The third arm is shorter than the first arm, and the hanging member has a thickness. A target disk has an elongated slot wherein the hanging member is inserted into the slot. The third arm extends through the slot and the second arm is received within the slot.

In accordance with another aspect of the disclosure, a hanging target frame assembly has a frame having a substantially U-shaped leg holding a horizontal bar and a hanging member having a first elongated arm, a second arm extending from the first arm and a third arm extending from the second arm. The first and third arms are parallel to each other and the second arm is perpendicular to the first and third arms. The third arm is shorter than the first arm, and the hanging member has a thickness. A target disk has an elongated slot wherein the hanging member is inserted into the slot, wherein the third arm extends through the slot and the second arm is received within the slot.

Another aspect of the disclosure is a target which is secured to a frame by hanging the target on the frame.

Another aspect of the disclosure is a target which is removable from the frame.

Still another aspect of the disclosure is a wire with a substantially L-shaped bend for holding the target.

Another aspect of the disclosure is a substantially L-shaped wire which is inserted into a horizontal or vertical slot in the target to prevent the wire from being hit by a bullet or pellet shot at the target.

Still another aspect of the disclosure is a wire of various thickness for insertion into horizontal or vertical slots.

Other aspects of the disclosure will become apparent upon a reading and understanding of the following detailed description.

BRIEF DESCRIPTION OF THE DRAWINGS

FIG. 2 is a front elevational view of a target disk in accordance with an aspect of the disclosure;

FIG. 3A is a side elevational view of a wire in accordance with an aspect of the disclosure;

FIG. 3B is a front elevational view of the wire of FIG. 3A;

DETAILED DESCRIPTION OF THE DISCLOSURE

This disclosure relates generally to indoor or outdoor shooting sports. More particularly, it relates to an apparatus for shooting hanging targets. It also relates to an apparatus for measurement and calibrations of gun sights.

The disclosure is an apparatus that can be secured to the ground or a holding device or frame with hanging wires and targets having slots for affixing the targets to the wires. The apparatus is transportable and can be made of a variety of materials. The targets can be made of clay or other suitable materials, and can be made of a variety of shapes and sizes with slots to be affixed to hanging wires.

Figure 1:
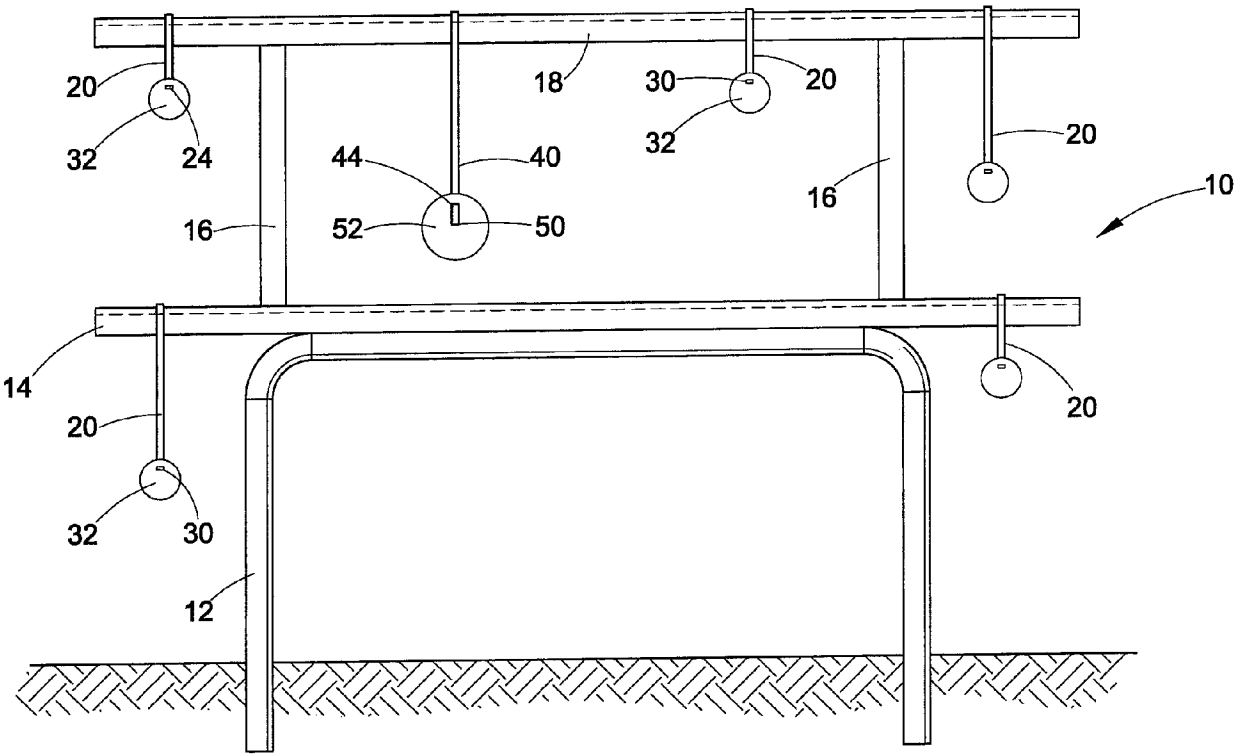
FIG. 1 is a front elevational view of a hanging target frame in accordance with one embodiment of the disclosure.

Referring now to FIG. 1, a hanging target frame 10 in accordance with a preferred embodiment of the present disclosure is shown. The frame itself can be made of a variety of materials, such as metal, steel, or reinforced plastic. The frame can also be made of flexible or pliable material to withstand the impact of a gunshot to one of the targets. The frame material can be resilient to allow the frame to return to its normal state after absorbing the impact of a gunshot.

The frame can have a substantially U-shaped leg assembly 12 which supports a horizontal bar or beam 14. Beam 14 can have several vertical bars or members 16 on which a second horizontal bar or beam 18 is mounted. Extending from each beam 14, 18 is hanging wire 20, 40. Wire 20 is preferably a flat metal wire which can have various lengths, such as several inches or feet.

Referring now to FIGS. 3A and 3B, a wire 20 can have a substantially L-shaped bend 22 having a first elongated wall 21 and a thickness $T_2$ in the range of 1 mm to 2 mm, preferably of about 1.5 mm or 0.06 inches. First arm or wall 21 extends vertically and can have various lengths $L_1$ such as 20 mm or more. A second arm or wall 24 also extends vertically and has a length $L_3$ dimension of about 3 mm or 0.12 inches in length. However, other length and dimensions are also contemplated by the disclosure. A horizontal arm wall or 26 has a length $L_2$ of about 6 mm or 0.24 inches. In the embodiment of FIG. 3B, the wire has a width $W_2$, of about 3 mm or 0.12 inches. Second vertical arm 24 has a length $L_3$ of about 3 mm.

The wire is inserted into a corresponding horizontal slot 30 formed in a target disk 32 as shown in FIG. 2. Slot 30 has a horizontal width dimension $W_1$ of about 4 mm (about 0.16 inches) and a thickness $T_1$ of about 2 mm (about 0.08 inches). The slot is positioned at a distance $P_1$ of about 10 mm from an outer end of the disk. Other lengths, widths, and other dimensions are contemplated by the disclosure.

Referring again to FIG. 2, the target disk itself can have various dimensions such as an overall radius dimension $R_1$ of about 50 mm (about 2 inches) or 100 mm (about 4 inches) or more or less. The wire is inserted into horizontal slot 30 such that vertical arm 24 extends through the slot and is at least partially visible from the front of the target (see FIG. 1), and horizontal arm 26 is positioned horizontally within the slot. The target then hangs from the wire as seen in FIG. 1.

In this embodiment the wire has a width which makes it potentially easier to hit with a bullet, a BB or pellet when the target is being shot at.

Figure 5B:
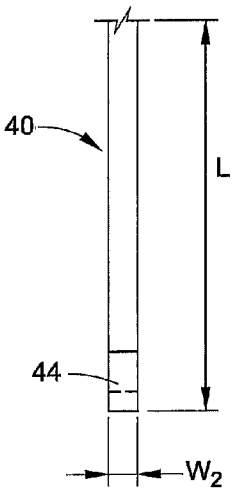
FIG. 5B is a front elevational view of the wire of FIG. 5A.
Figure 5A:
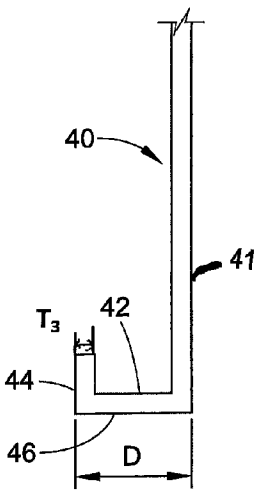
FIG. 5A is a side elevational view of a wire in accordance with another aspect of the disclosure.

In accordance with a preferred embodiment of the present disclosure, referring now to FIGS. 5A and 5B, an alternate wire 40 can have an L-shaped bend 42 with a first vertical arm or wall 41 which has a length $L_4$ which can vary from about 20 mm or more with a thickness $T_3$ of about 1.5 mm or about 0.06 inches. The wire has a second vertical arm 44 which extends vertically and has a length dimension $L_6$ of about 3 mm or about 0.12 inches in length. A horizontal arm 46 has a length $L_5$ of about 6 mm or about 0.24 inches.

Figure 4:
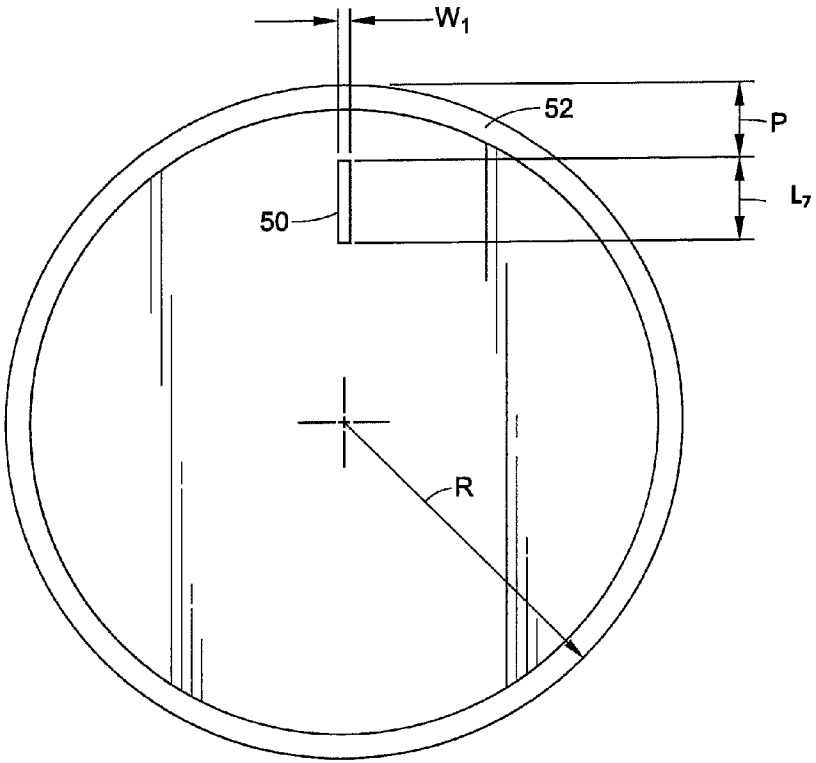
FIG. 4 is a front elevational view of a target disk in accordance with another aspect of the disclosure.

Referring to FIG. 5B, the wire has a width $W_4$ of about 1.75 mm (about 0.07 inches). The wire is inserted into a corresponding vertical slot 50 formed in a target disk 52 as shown in FIG. 4. Slot 50 preferably has a vertical dimension or length $L_7$ of about 4 mm or about 0.16 inches and a horizontal dimension or width $W_3$ of about 2 mm or about 0.08 inches. The slot is positioned at position $P_2$ of about 4 mm from an outer end of the disk.

The target disk 52 itself can have various dimensions, radiuses or thicknesses, such as a radius $R_2$ having a dimension of about 50 mm (2 inches) or 100 mm (about 4 inches). The flat wire is inserted into the vertical slot such that vertical arm 44 extends through the slot and is visible from a front of the target (see FIG. 1), and horizontal arm 46 is positioned horizontally within the slot. Since the width $W_4$ of the wire is only 1.75 mm (about 0.07 inches), the wire is much harder to hit by a bullet or pellet being shot at the target. This protects both the wire and the target hanging from the wire. This also minimizes the target following off of the wire. The target hangs from the wire as seen in FIG. 1.

The target itself can be of various colors and shapes and sizes (such as about 2 inches by 2 inches). Also, various lengths of wires and sizes of targets can be hung on frame 10 as seen in FIG. 1. The targets can be attached to the frame by any suitable retaining means. The target can be made of clay or metal or plastic, and can be made to shatter upon impact of a bullet or pellet. The target can also be made to explode on impact from a bullet or pellet. For example, a powder pack can be placed within the target. The target shape itself can vary, such as a disk, a "deer shape", a "turkey shape", a "pigeon shape", etc.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A hanging target frame assembly, comprising:

a frame comprising a substantially U-shaped leg holding a horizontal bar;

a hanging member extending from said frame, said hanging member having a first elongated arm, a second arm extending from said first arm and a third arm extending from said second arm, wherein said first and third arms are parallel to each other and said second arm is perpendicular to said first and third arms; wherein said third arm is shorter than said first arm, and said hanging member having a thickness; and a target disk comprising an elongated slot wherein said hanging member is inserted into said slot, wherein said third arm extends through said slot and said second arm is received within said slot.

2. The target of claim 1, wherein said slot is elongated in a horizontal direction.

3. The target of claim 1, wherein said hanging member is substantially L-shaped in conformation.

4. The target of claim 1, wherein said slot is elongated in a vertical direction.

5. The target of claim 1, wherein said hanging member comprises flat metal wire.

6. The target of claim 1, wherein said third arm protrudes in front of a surface of said target disk.

7. The hanging target frame assembly of claim 1, wherein said hanging member has a width of about 0.12 inches.

8. The hanging target frame assembly of claim 1, wherein said slot has a width of about 0.16 inches.

9. The hanging target frame assembly of claim 1, wherein said hanging member has a thickness of about 0.06 inches.

10. The hanging target frame assembly of claim 1, wherein said slot has a thickness of about 0.08 inches.

11. The hanging target frame assembly of claim 1, wherein said hanging member has a width of about 0.07 inches.

12. The hanging target frame assembly of claim 1, wherein said slot has a width of about 0.08 inches.

* * * * *